US007198529B2

(12) United States Patent
Cleary

(10) Patent No.: US 7,198,529 B2
(45) Date of Patent: Apr. 3, 2007

(54) RECREATIONAL WATERCRAFT WITH HYDROFOIL

(76) Inventor: James M. Cleary, 92 Mc Callum Dr., Falmouth, MA (US) 02540

( * ) Notice: Subject to any disclaimer, the term of this patent is extended or adjusted under 35 U.S.C. 154(b) by 0 days.

(21) Appl. No.: 11/212,541

(22) Filed: Aug. 26, 2005

(65) Prior Publication Data

US 2006/0042536 A1 Mar. 2, 2006

Related U.S. Application Data

(60) Provisional application No. 60/605,645, filed on Aug. 30, 2004.

(51) Int. Cl.
*B63H 16/00* (2006.01)

(52) U.S. Cl. ..... 440/21; 114/347

(58) Field of Classification Search ..... 440/13–15, 440/21, 22, 25, 101, 102; 114/55.56, 253, 114/363; 441/65, 74
See application file for complete search history.

(56) References Cited

U.S. PATENT DOCUMENTS 2,948,255 A * 8/1960 Sbrana ..... 440/21
3,377,977 A * 4/1968 Malm ..... 440/13
3,640,240 A * 2/1972 Stein ..... 440/15
3,677,216 A * 7/1972 Gentemann ..... 440/102
3,833,956 A * 9/1974 Meehan ..... 441/76
4,303,402 A * 12/1981 Gooding ..... 440/101
4,936,802 A * 6/1990 Ueno ..... 440/13
4,979,454 A * 12/1990 Van Den Heuvel ..... 114/55.56
5,041,037 A * 8/1991 Jaw ..... 440/102
6,468,118 B1 * 10/2002 Chen ..... 440/21

FOREIGN PATENT DOCUMENTS

WO WO 92/02409 * 8/1990

* cited by examiner

*Primary Examiner*—Ed Swinehart
(74) *Attorney, Agent, or Firm*—Thomas A. Kahrl

(57) ABSTRACT

A recreational watercraft device consisting of a light hull in the shape of a sail board hull and on the bottom a strut hydrofoil assembly. The hydrofoil has a bilateral symmetric plan-form with a pivot connection at the center of the hydrofoil span. The pivot connection joins the hydrofoil to the strut. The strut has a streamline cross-section. The plane of symmetry of the strut is positioned in the plane of symmetry perpendicular to the span of the hydrofoil. In operation the rider stands on the hull and reciprocates the hydrofoil up and down via a strut having a T handle. The elements of the strut hydrofoil assembly comprise a foil, a pivot, a strut, a T handle, and extension.

5 Claims, 9 Drawing Sheets

RECREATIONAL WATERCRAFT WITH HYDROFOIL

"NON PROVISIONAL" APPLICATION

This is a complete "Non-Provisional" patent application which is filed less than 12 months from the filing date of a "Provisional" application, Application No. 60/605,645 which was filed Aug. 30, 2004.

BACKGROUND OF THE INVENTION

Watercraft sports have become increasingly popular particularly in the areas of wind surfing, sculling and more recently sea kayaking. Wind Surfing requires good balance, upper body strength as well as appropriate wind conditions. In particular, wind surfing typically may require several sizes of sails as well as boards, each of which are costly and require ample storage and transport facilities. Sculling and sea kayaking involve operating from a seated position in watercraft having a narrow beam. Each require a good sense of balance and accordingly appeal to a limited clientele, specifically those having requisite physical skill and physical conditioning. Furthermore, an active person who engages in each of these related watercraft sports, would need a substantial array of equipment to participate, including multiple hulls, masts, oars, paddles, rigging and sails.

Accordingly, it is desirable to provide for a new and improved Recreational Watercraft with Hydrofoil to provide for hand propulsion, which is simple to operate and overcomes at least some of the disadvantages of prior art.

SUMMARY OF THE INVENTION

The present invention is a recreational watercraft comprising a lightweight slender hull driven by a strut hydrofoil assembly including a hydrofoil pivot mounted on a strut extending through a penetration in the hull. An operator of this recreational watercraft stands on the hull and, grasping a T handle, reciprocates the foil up and down below the hull by means of the strut. The operator ordinarily stands in a cockpit located in the central portion of the hull. A brace is fixed above and athwart the aft end of the cockpit to aid the balance of the operator. Except for certain special features hull shape can similar to some popular kayak designs.

Foil Strut Assembly:

In the present invention the foil strut assembly comprises a hydrofoil, a pivot, a strut, a T handle, and an extension to the T handle. The hydrofoil has a bilaterally symmetric plan-form. A pivot connection joins the foil to the strut. The axis of the pivot is parallel to the span of the foil and perpendicular to the long axis of the strut. The strut has a streamline cross-section. The long axis of the strut cross-section is perpendicular to the axis of the pivot.

The pivot axis is positioned closer to the leading edge of the foil than is the center of hydrodynamic lift on the foil. In the case of a symmetrical uniform section foil, the lift center is approximately ¼ of the cord length from the leading edge. The preferred embodiments of the present invention include foils with span-wise taper with varying amounts of sweep. It is preferred that the pivot axis be more than 6% of the mean cord length forward of the lift center.

The geometry of the strut foil pivot assembly is such that the cord plane of the foil is free to tilt upward or downward through limited angles. These angles are preferably in the range +/−15° to +/−25°.

Because the pivot axis is forward of the lift center, upward thrust of the strut on the foil tilts the leading edge of the foil upward in the direction of motion. Conversely, a downward thrust tilts the leading edge of the foil downward.

A T handle is mounted at the upper end of the strut, and preferably includes a tubular extension. The extension telescopes with the strut and includes a locking feature so that the strut-extension assembly can be adjusted to various lengths.

Hull

The slender, lightweight hull includes a penetration or well located forward from the hull center. The well is located on the center plane roughly an arms length or about two feet forward of the normal standing position of the operator on the hull. The well is a tapered tube having an elliptical cross section. The small end of the tube intersects the bottom of the hull. The large end of the tube is directly above the bottom end and significantly above the waterline. The well tapers outward to a much broader elliptical opening at the upper end. The longer axis of the elliptical section are parallel to the long axis of the hull. The taper allows the strut to pitch fore and aft and side to side with respect to the hull.

The hull has a skeg or fin at the stern. The skeg is preferably fixed to the stern as a separate fin, but may be molded into and blended with the aft end of the hull.

Foil

The hydrofoil shapes referred to in this discussion is not fundamentally different from airfoil lifting shapes used in aircraft. The customary term hydrofoil is used because the foil is immersed in water. The hydrofoils or foils of this discussion are shapes used to generate lift normal to the direction of motion through a fluid with minimum drag. They are similar to airfoil structures used in aircraft and to dagger-boards used in sailing craft. In the case of a dagger-board, a symmetrical cross-section is employed to provide lift normal to the cross-section with equal efficiency in either direction. In the case of an aircraft wing, the section is asymmetrical (cambered) with the mean-line of the cross-section concaved downward. This asymmetry provides the aircraft with a greater maximum upward lift before stall. In the case of the present invention, the up and down loads imposed on the foil are of similar magnitude, so a symmetrical section is appropriate. A wide range of published airfoil cross-sections may be chosen for use in the present invention, for example, "Theory of Airfoil Sections" by Abbot and Von Doenhoff. The present invention is not limited to a particular foil cross-section. However; the family of foil cross-sections more suited to the present invention will have symmetrical or nearly symmetrical cross sections with ratios of maximum thickness over cord length in the range 0.8 to 0.14, and with the maximum section thickness less than 40% of the cord length from the leading edge.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
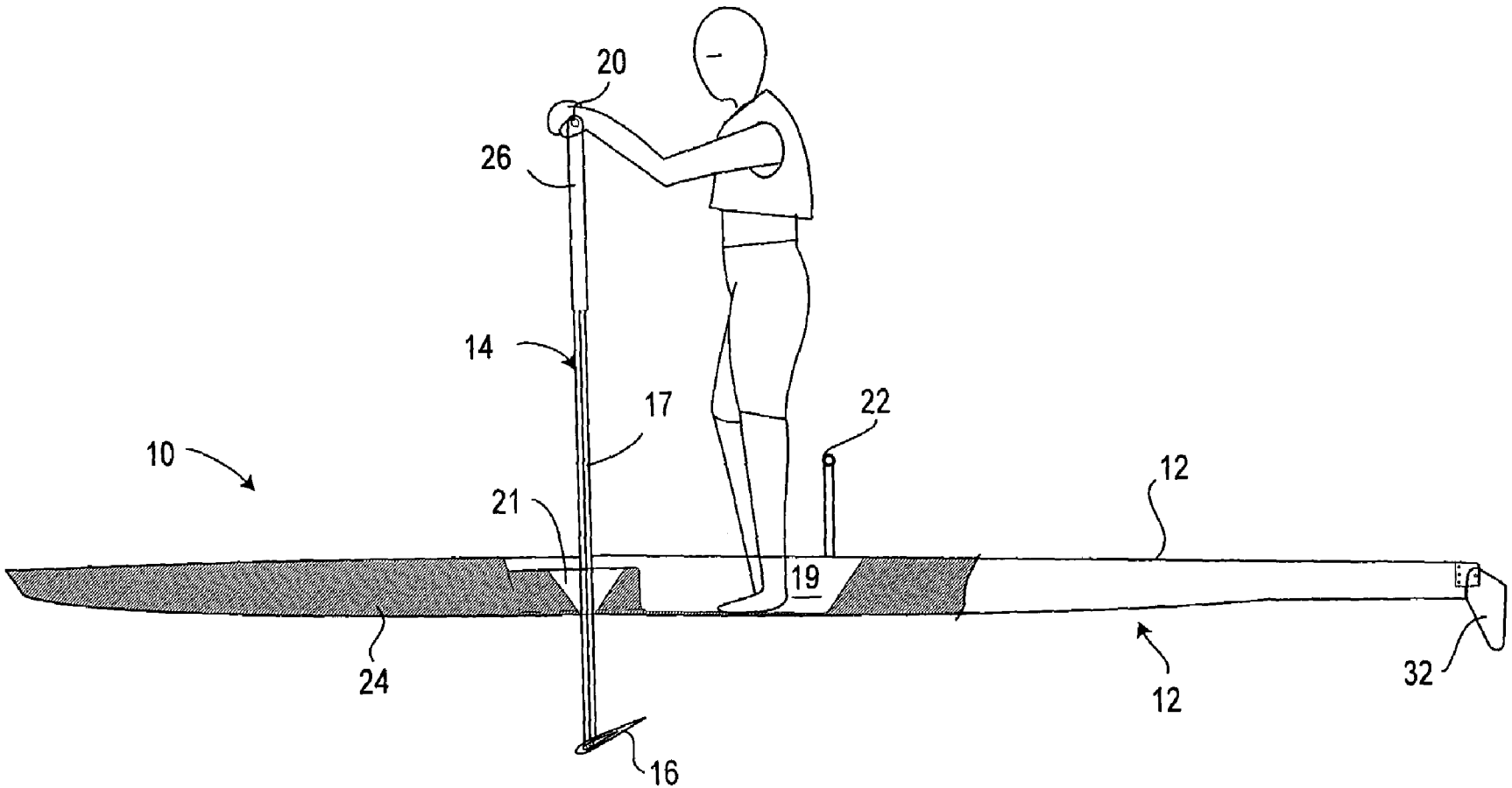
FIG. 1 is a side view of the recreational watercraft of the present invention with the hull in partial longitudinal section and shown with a strut hydrofoil assembly extending through a well, and with the operator standing and operating the foil assembly.

Referring to FIGS. 1–8, there is shown a recreational watercraft 10 comprising a lightweight slender hull 12 and a strut hydrofoil assembly 14 including a hydrofoil 16 pivotally connected to strut 17. An operator 18 stands in cockpit 19 and reciprocates hydrofoil 16 up and down below hull 12 by means of strut 17 with a T handle 20. Preferably, T handle 20 is about shoulder width.

As is shown in FIG. 1, strut 17 extends through well 21 penetrating hull 12 near the forward end of cockpit 19. Operator 18 ordinarily stands in 19 immediately forward of brace 22. Brace 22 extends across the after end of cockpit 19 roughly 18" above the bottom of said cockpit 19. Operator 18 is greatly aided in maintaining balance by applying pressure against brace 22 with the back of the leg. Brace 22 is easily removed so the operator 18 can sit and paddle, as in a conventional kayak shown in FIG. 9. The brace 22 may have more than one mounting position to accommodate operators of different sizes.

Figure 2:
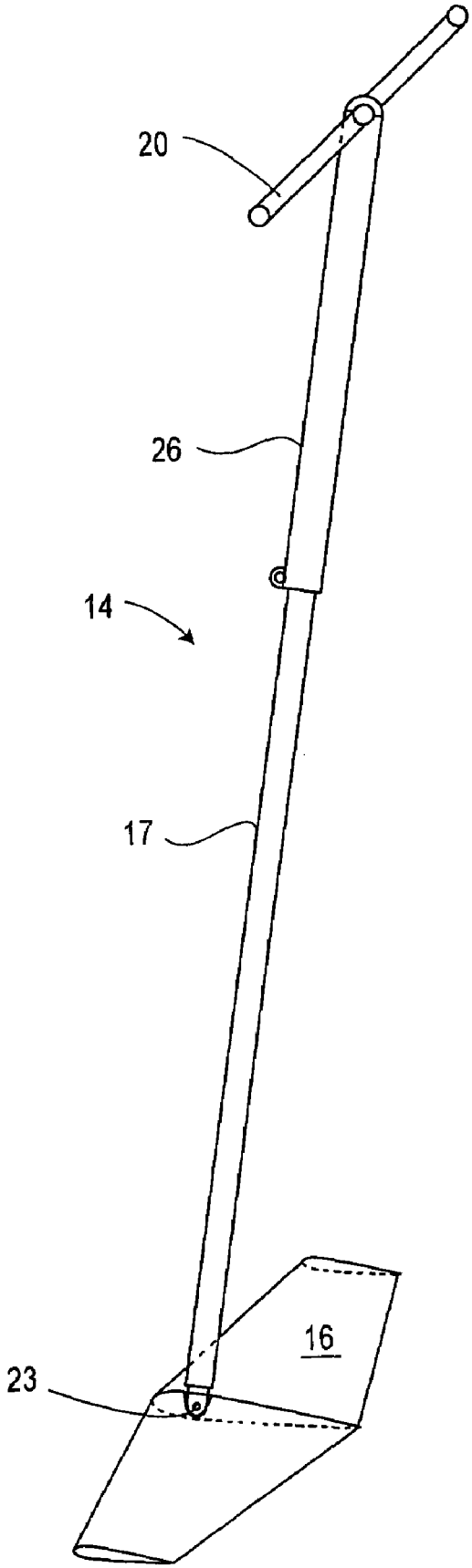
FIG. 2 is an oblique view of the strut hydrofoil assembly of the present invention of FIG. 1.
Figure 3:
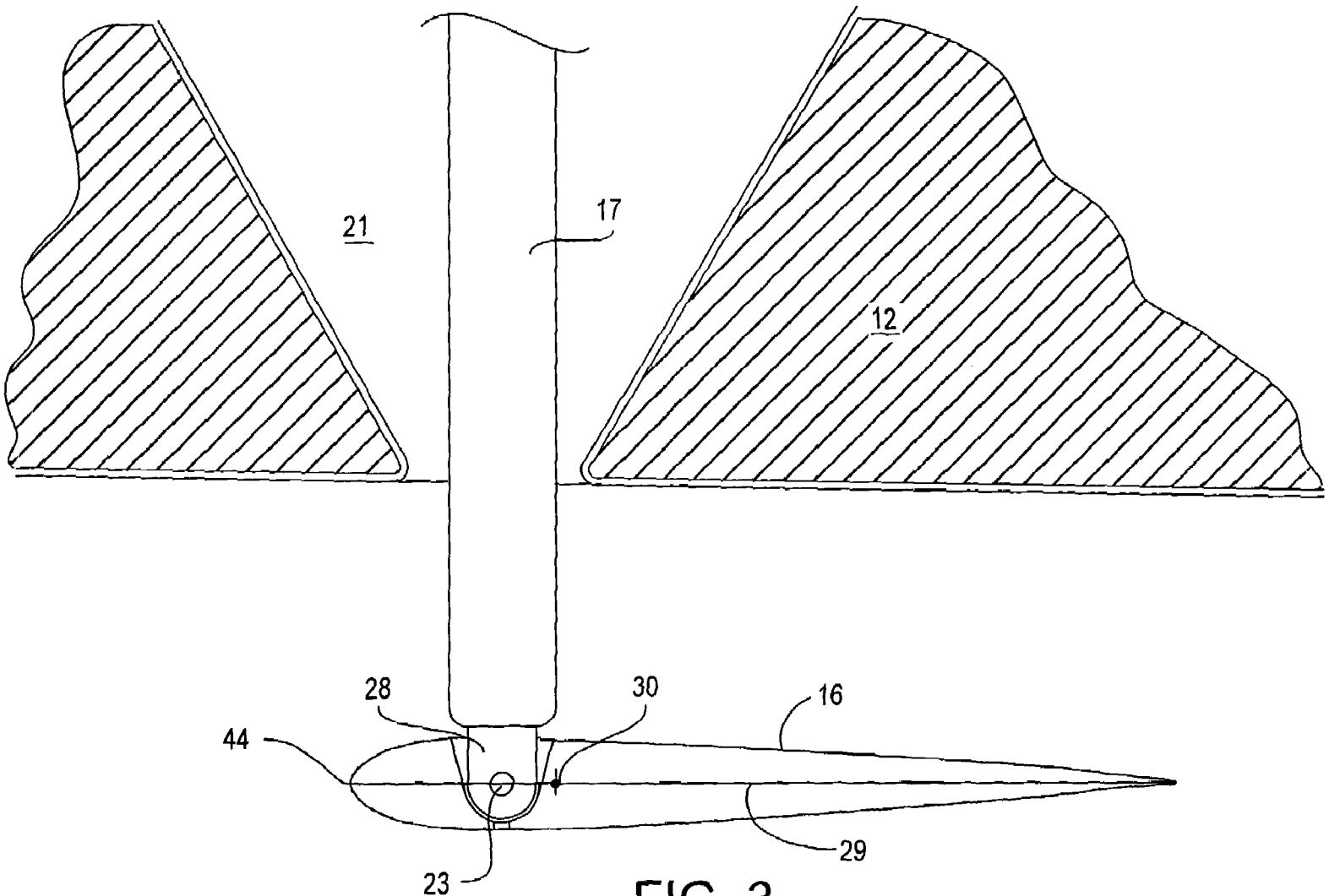
FIG. 3 is an enlarged fragmentary sectional view of the strut hydrofoil assembly of FIG. 1 showing the strut extending down through the well in the hull.
Figure 4:
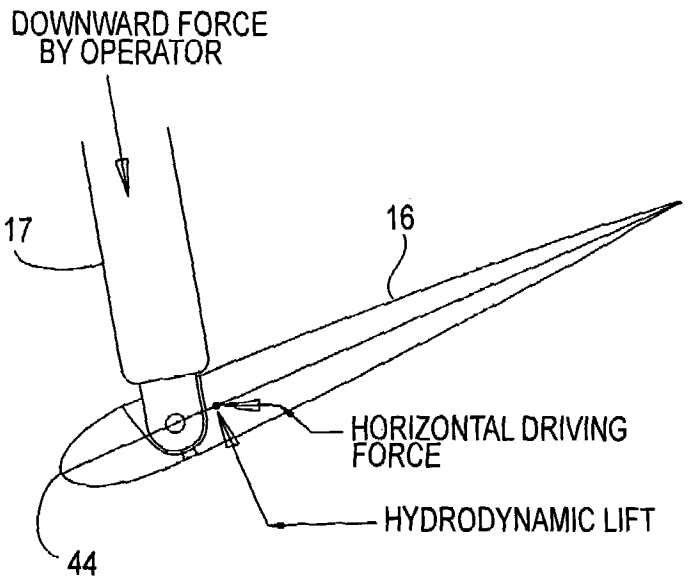
FIG. 4 is a side view in section of the strut hydrofoil assembly with the foil leading edge angled downward, and showing forces acting on the hydrofoil during the down stroke.

As is shown in FIGS. 2–4, hydrofoil assembly 14 comprises hydrofoil 16, pivot 23, strut 17, T handle 20, and handle extension 26. Hydrofoil 16 has a bilaterally symmetric plan-form with a pivot connection 28 at the center of the span of hydrofoil 16. The pivot connection 28 joins hydrofoil 16 to strut 17. The plane of symmetry of strut 17 is positioned in the plane of symmetry perpendicular to the span of hydrofoil 16. The strut 17 has a streamline cross-section. An opening on the bottom side of hydrofoil 16 below the pivot helps the pivot assembly clear its debris.

As is shown in FIG. 3, pivot axis 23 of the foil strut connection 28 is parallel to the span of the hydrofoil 16. The pivot axis 23 is positioned on or near cord line 29, and closer to the leading edge of the hydrofoil 16 than the center of hydrodynamic lift 30 as shown in FIG. 3. In the case of a symmetrical section foil 16, as shown in FIG. 3, lift center 30 is approximately ¼ of the cord length from the leading edge. Embodiments of the present invention may include hydrofoil span-wise taper with varying amounts of sweep. It is preferred that the pivot axis is more than 6% of the mean cord length forward of lift center 30.

In the above discussion the foil geometry shown in the figures was chosen in part for simplicity and ease of illustration. All cord lines fall in a common plane and the sweep of the leading edge 44 is such that the ¼ cord position of each cord line along the span is on the same straight line. Other hydrofoil geometries within the scope of this invention with different sweep angles will have lift centers at positions other than the ¼ cord position of the center section. Also, hydrofoils within the scope of the invention may have dihedral and angles, which elevate the hydrodynamic lift center of the hydrofoil to a point near and above the top of the cross section at the center span. In this last case the best position for the pivot axis moves toward the top of the section.

Because pivot axis 23 is forward of lift center 30, upward thrust of the strut 17 on the hydrofoil 16 tilts the hydrofoil 16 upward in the direction of motion. Conversely, a downward thrust tilts the hydrofoil 16 downward. See FIGS. 4 and 5.

Figure 13:
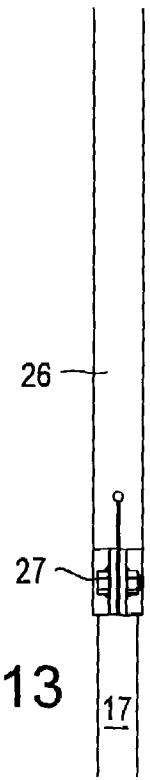
FIG. 13 is a front view of the T handle extension.
Figure 12:
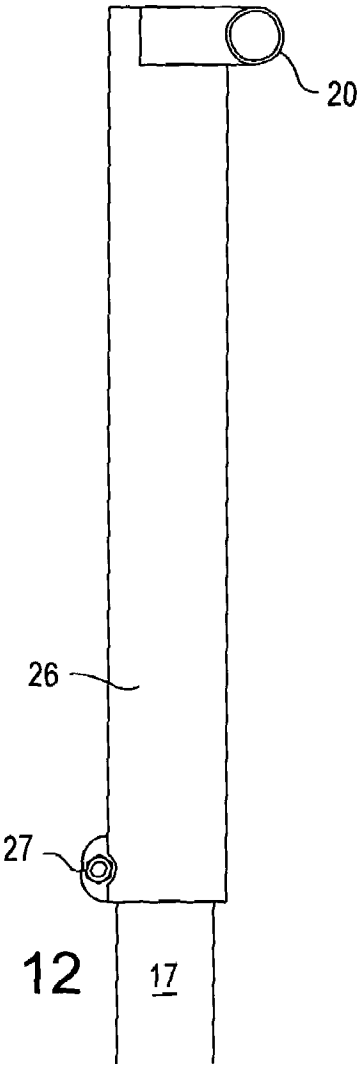
FIG. 12 is a side view of the T handle, and extension.
Figure 11:
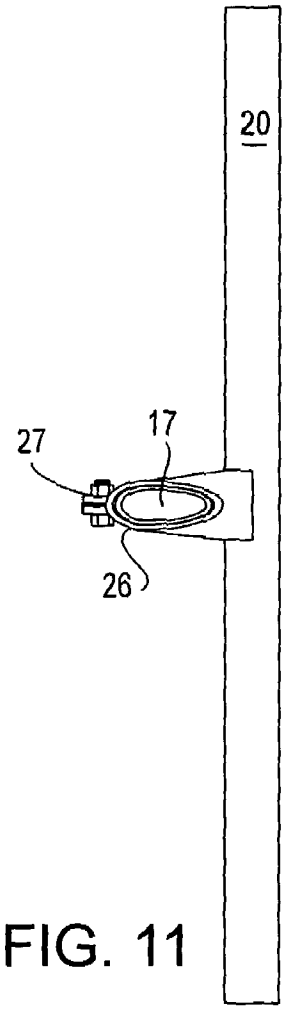
FIG. 11 is a view from above of the T handle, and extension.

As is shown in FIG. 2, a T handle 20 is mounted at the upper end of the strut 17. The T handle 20 preferably includes tubular extension 26, which telescopes with strut 17. Tubular extension 26 includes a locking means 31 so that strut 17 plus extension 26 can be adjusted to various lengths. FIGS. 11, 12 & 13 shows an embodiment of strut 17 plus extension 26 in three fragmentary views, top, side and front. Locking means 31 shown in FIG. 111 is a threaded fastener which clamps a split lower position of extension 26 tightly onto an upper portion of strut 17.

As is shown in FIG. 3, pivot connection 28 of hydrofoil assembly 14 limits upward or downward tilt angles of foil 16 with respect to the strut axis. These angles are in the range +/−10 to +/−30°, defining zero angle as having the cord lines of the foil perpendicular to the long axis of 17.

As is shown in FIG. 1, hull 12 has a skeg 32 mounted on the stern portion of hull 12 as a separate unit. As an alternative embodiment, Skeg 32 may be molded in as an integral part of hull 12.

Figure 6:
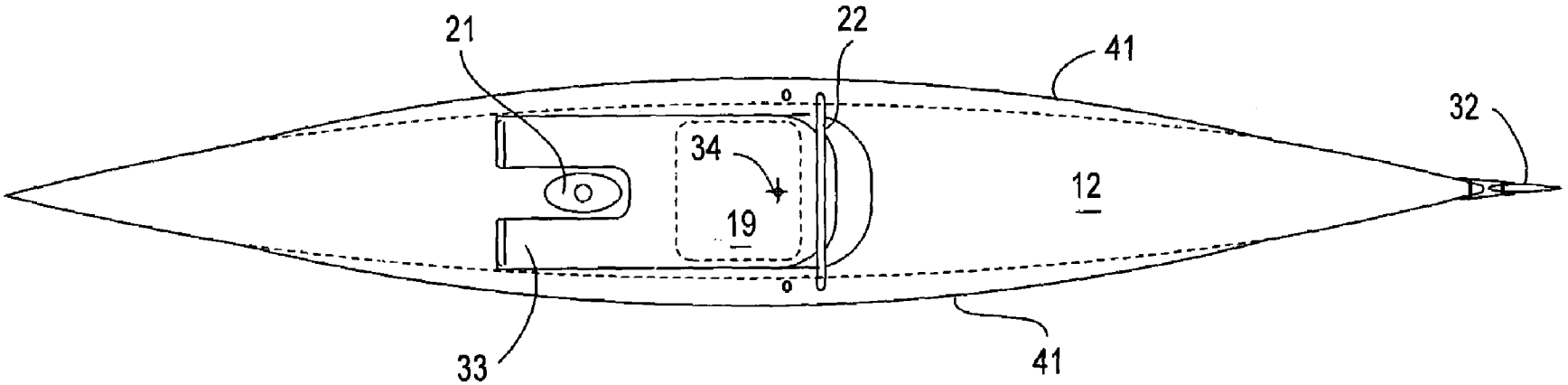
FIG. 6 is a view from above of the recreational watercraft of FIG. 1.
Figure 8:
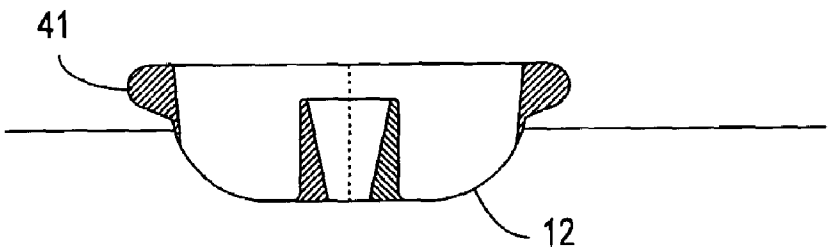
FIG. 8 is a transverse section view of the watercraft of FIG. 6, the section is taken through the center of the well looking forward.
Figure 7:
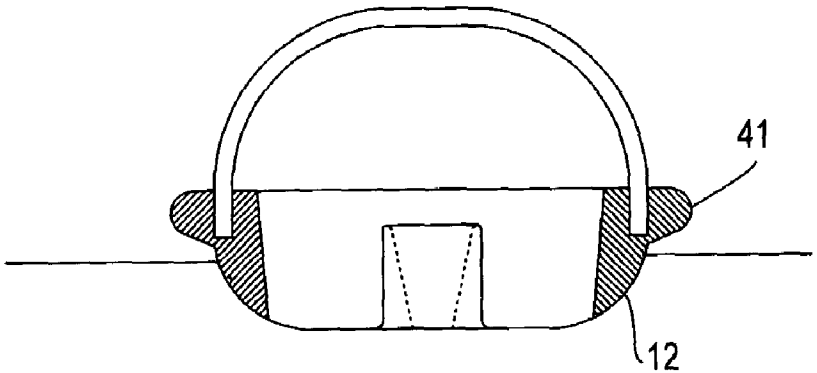
FIG. 7 is a transverse section view of the watercraft of FIG. 6, the section is just aft of the brace looking forward.

A preferred embodiment of cockpit 19 is shown in FIG. 6 provides leg-room 33 for the operator to sit and paddle as with a kayak. Cockpit 19 of FIGS. 1, 6, 7, and 8 is similar to the cockpit of a sit-on type kayak. The sit-on kayak is characterized by a completely open cockpit with minimal volume, with the hull forming a water-tight shell. In FIGS. 6, 7, and 8 the cross hatched section areas 24 are water tight regions of the hull. The hull portion of the present invention may be constructed by modifying a kayak. In this case, well 21 and brace 22 are added to a conventional kayak hull.

FIG. 6 shows cockpit 19 extends behind the normal center of buoyancy 34 and far enough forward from the center of buoyancy to provide leg-room 33 for a seated paddler. We define the normal center of buoyancy as the center of buoyancy under the combined weight of the hull plus operator 18 when the hull is trimmed properly in the water. The weight of the operator 18 is generally far greater than the weight of the hull. Therefore; operator 18 generally stands and maneuvers close to normal center of buoyancy 34.

The hull includes a removable brace 22 athwart the aft end of the cockpit close behind the normal center of buoyancy 34 and roughly 18" above the bottom of the cockpit. The best standing position for the operator can be defined only approximately. The center of buoyancy is always located under the combined center of gravity of the hull and operator. The best position of operator 18, standing or seated, is located to give the hull proper trim in the water. The weight of the operator will vary and the optimum trim for the hull cannot be defined precisely.

Figure 10:
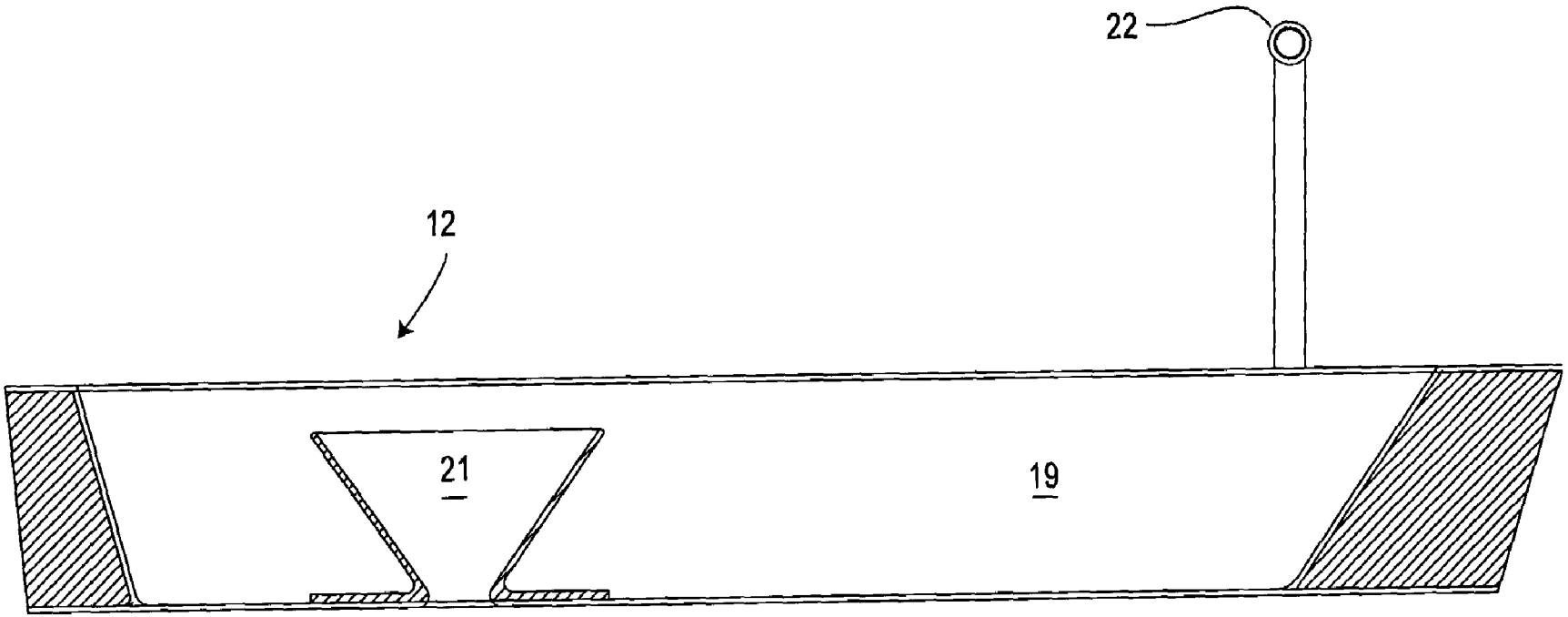
FIG. 10 represents a center plane longitudinal section through the cockpit of a conventional sit-on kayak hull converted for use as part of the present invention by installation of the well, and the brace.

Well 21 is located roughly 2 feet (about one arms length) forward from the normal standing position of operator 18. Well 21 is a tapered tube having an elliptical cross section. The small end of the tube intersects the bottom of hull 12 on the hull centerline. The large end of the tube is directly above the bottom end, and is significantly above the waterline. Normally the top of 21 intersects the deck. However in some embodiments (See FIG. 10) the top end of 21 does not intersect the deck because the deck may be absent at its location. Well 21 tapers outward to a much broader elliptical section opening at the upper end. The long axes of the elliptical sections are parallel the long axis of hull 12. Use of the term elliptical here is descriptive, not mathematical, the cross sections of 21 may vary widely from a mathematical ellipse.

Preferably, the taper of well 21 is at least +/−30° fore and aft, and at least +/−15° to the sides. The taper of 21 allows strut 17 to tilt forward, back and to the sides. Operator 18 is also able to rotate strut 17 on its axis through 360° by means of T handle 26. The smaller end of 21 at the bottom of the hull is preferably just large enough to provide clearance on strut 17 when said strut is tilted to maximum angles.

Figure 9:
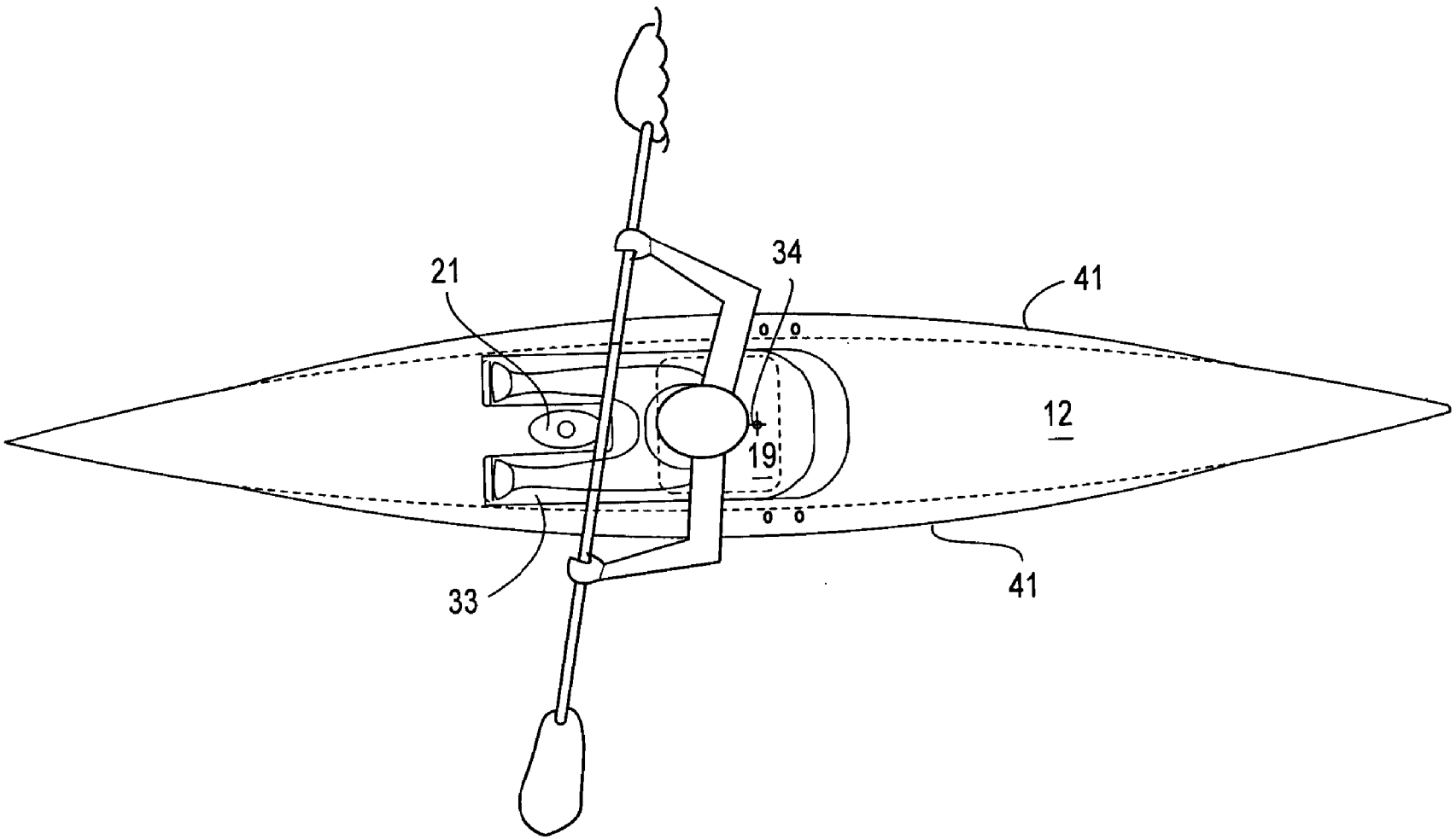
FIG. 9 is a view from above of conventional sit-on kayak hull with the brace removed and with the operator seated and paddling as with a conventional kayak.

FIG. 9 shows a top view of the hull 12 with the operator seated and paddling. Brace 22, and skeg 32, and assembly 14 have been removed.

The design of the hull, as is well known in the design of kayaks and other small watercraft, is always a trade-off between the need for stability and the desire for a low drag shape. FIGS. 7 and 8 show sections through hull 12 of FIG. 6. These figures show a desirable feature combining low drag with needed stability. Lateral lobes or sponsons 41 extend hull 12 laterally above the waterline. Sponsons 41 provide what is normally termed secondary stability (righting moments that increase significantly when the hull tips to the side). The sponson 41 is a well known design feature that is especially advantageous to the present invention.

Operating Configuration

Figure 5:
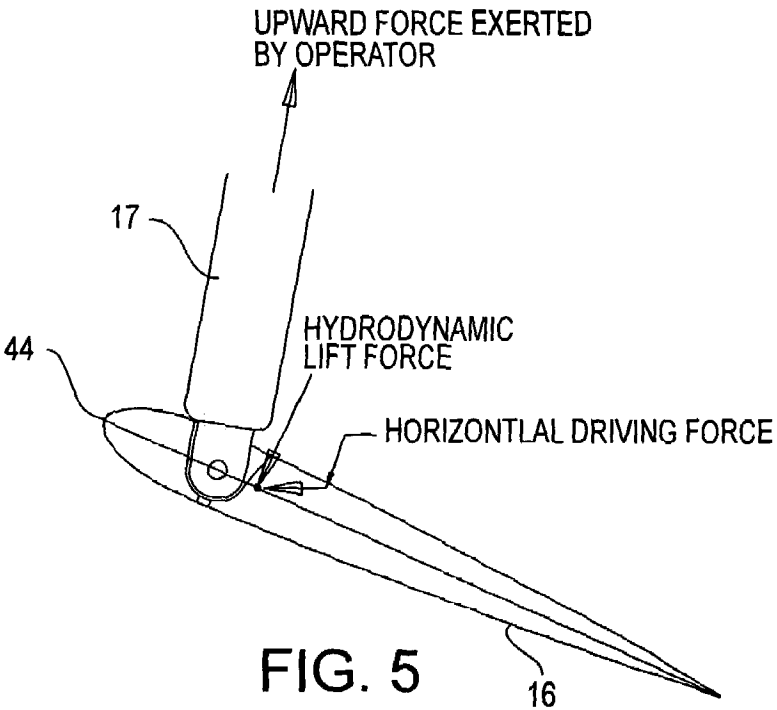
FIG. 5 is a side view of the strut hydrofoil assembly with the foil leading edge angled upward, and showing forces acting on the hydrofoil during the up stroke.

FIGS. 3, 4, and 5 illustrate the operation of foil 16 when driven by strut 17. In operation, strut 17 extends upward through well 21 to extension 26 of T handle 20. Operator 18 stands aft of strut 17 and well 21. In operation (see FIG. 1), the operator 18 grasps the T handle 20, and reciprocates foil strut assembly 14 forcefully up and down. Because pivot 23 is forward of the lift center 30, leading edge 44 inclines downward when foil 16 is forced downward. As a result, the lift force on 16 has a forward component-driving watercraft 10 forward. Conversely, when the foil 16 is forced upward, leading edge 44 inclines upward. The lift force on the foil 16 again has a forward component driving watercraft 10 forward. The most comfortable efficient movement for operator 18 inclines the strut forward on the down stroke and backward on the upstroke. This inclination of the strut during the normal operating cycle adds to the inclination of the foil on both up and down strokes as illustrated in FIGS. 4 and 5. The taper well 21 permits the axis of the strut 17 to tilt substantially relative to hull 12.

This freedom of motion is important for the following reasons:

1. The comfortable natural reciprocation of 14 by operator 18 includes cyclic for and aft tilting motion of strut 17.
2. A skilled operator will discover that controlled forward tilting of the strut 17 on the down stroke and backward tilting on the up stroke produces more effective propulsion, and that the motion of strut 17 relative to hull 12 is complicated by steering requirements and wind and sea conditions.
3. Hull 12 must be allowed to roll and pitch without forcing this motion on assembly 14.
4. If there is a collision of foil 16 with bottom or with a submerged object, foil 16 can move rearward relative to 12 as the strut 17 tilts forward, allowing deceleration of 12 and operator 18 over a reasonable distance.

The combined length of strut 17 plus T handle 24 is adjusted to the preference and height of the operator. For example, a 6' tall operator may comfortably reciprocate T handle 20 from 6.7' above deck level to less than 1.5' above deck. This 5.2' range of motion requires a water depth of more than 5.5'. The operator can accommodate shallower water depth by limiting the range of motion. This may be done more comfortably by grasping extension 26 below T handle 20.

The operator steers the watercraft by turning the T handle 20, and can also reverse thrust and backup by rotating the T handle 24 through 180°. Turning said T handle provides a lateral thrust component for steering. Skeg 3 contributes to the steering moment by concentrating lateral resistance toward the stern. The lateral thrust of foil 16, in addition to steering, generates an overturning moment, which is used as a source of dynamic stability by the skilled operator. The overturning moment is generated since the side thrust operates some distance below hull 12. This moment tends to throw the inexperienced operator off the side. However; with experience, the operator exploits this moment to create dynamic stability. The skilled operator learns to instinctively use the lateral thrust of the foil for lateral stability. This instinct is similar to that employed when riding a bicycle.

Self Bailing Feature

The aft end of cockpit 19 preferably has a sloping back wall as shown in FIG. 1. This surface aids the ejection of water from the cockpits when 10 is accelerated forward by a vigorous down stroke. Water will on occasion spill into the cockpit due to wave action or accidental tipping of the hull 12. The cockpit ramps up to the rear deck, providing a fair flow path for water ejection from the cockpit to the rear deck.

What is claimed is:

1. A recreational watercraft arranged to support a standing human operator comprising:

A. a lightweight slender hull having a deck and a bottom and a well located on the centerline of the hull and forward of the normal center of buoyancy thereof for moveably supporting a hand operated strut extending from the deck downwardly to and through the bottom;

B. A combination propulsion, stabilizing and steering means, comprising a hand operated strut having a long axis moveably supported in the well having a lower end and upper end with a pivot-mounted, fully submerged hydrofoil pivotally mounted on the lower end of the strut and a handle fixedly attached to the upper end thereof;

C. the fully submerged hydrofoil comprises a curved span having a lift center with a transverse pivot mounted at the center of the foil span and forward of the lift center of the foil; with i) the pivot axis parallel to the span of the foil;

ii) the long axis of the strut is perpendicular to the pivot axis;

iii) the strut has a streamlined cross section, the long axis of which is perpendicular to the span of the foil;

iv) the well allows rotation of the hydrofoil affixed to the strut through 360 degrees; and iv) the pivot allows rotation of the foil about the pivot axis with respect to the strut through limited angular travel less than +/−30°; and D. the well extends from above the hull's waterline downward through the hull to the bottom of said hull to allow rotation of the hydrofoil affixed to the strut through 360 degrees, where the operator of the watercraft stands on the hull and manually operates the hand operated strut to steer, stabilize and drive the watercraft through the water, selectively in all directions.

2. The recreational watercraft of claim 1 wherein the operator of the recreational watercraft stands on the hull and operates said recreational watercraft by reciprocating the foil up and down below the hull by means of the strut with a T handle to propel, steer, and stabilize the watercraft in all directions.

3. The recreational watercraft of claim 1 wherein said well;

a. is a tapered tube with elliptical cross-sections whose long axes are on the plane of symmetry of the hull;

b. has a small end at the bottom of said hull large enough to provide clearance on the strut in all operating positions;

c. has a taper expanding outward and upward that allows said strut to tilt within the well forward and back at least +/−30° and to the sides at least +/−15, and also allows the operator to rotate the strut within said well by means of the T handle;

d. wherein the strut extends through the well in the hull and is free to pivot freely about the bottom of the well such that the bottom of the well serves as a universal pivot for the strut with respect to the hull;

e. the strut is free to tilt forward, backward and to the sides as well as being able to rotate on its axis, as it slides up and down in the well.

4. The recreational watercraft of claim 1 where said hull is a kayak having a cockpit to which;

a. a tapered well is added to the bottom near the forward end of the cockpit; & b. a brace is mounted near the rear end of the cockpit.

5. The recreational watercraft of claim 1 wherein the hull has a removable brace extending athwart the aft end of said cockpit and more than 1 foot above the bottom of the cockpit to aid the balance of the operator while standing on the hull and manually operating the hand operated strut to steer, stabilize and drive the watercraft through the water.

* * * * *